US007111730B1

(12) United States Patent
Alas

(10) Patent No.: US 7,111,730 B1
(45) Date of Patent: Sep. 26, 2006

(54) BAT CARRIER AND PROTECTOR

(76) Inventor: Michael Phillip Alas, 3560 Capalina Rd., San Marcos, CA (US) 92069

( * ) Notice: Subject to any disclaimer, the term of this patent is extended or adjusted under 35 U.S.C. 154(b) by 3 days.

(21) Appl. No.: 11/125,481

(22) Filed: May 9, 2005

(51) Int. Cl.
*B65D 85/20* (2006.01)

(52) U.S. Cl. ..... 206/315.1

(58) Field of Classification Search ..... 206/315.1, 206/315.2, 315.9, 315.11, 579; 224/917, 224/919

See application file for complete search history.

(56) References Cited

U.S. PATENT DOCUMENTS 3,830,362 A * 8/1974 Tassone et al. ..... 206/579
3,909,031 A * 9/1975 Schmaedeke et al. .... 206/315.1
4,422,645 A * 12/1983 Simons ..... 206/315.1
4,890,731 A * 1/1990 Mroz ..... 206/315.1
5,695,067 A 12/1997 Harvey
6,168,016 B1 1/2001 Lawson
D476,151 S * 6/2003 Peterson ..... D3/254
2004/0262178 A1 12/2004 Speck

* cited by examiner

*Primary Examiner*—Luan K. Bui
(74) *Attorney, Agent, or Firm*—Edwin P. Tarver; Patel & Alumit, P.C.

(57) ABSTRACT

A single bat carrier that can be used conveniently in a baseball or softball game to carry and transport a user's bat is disclosed in the present invention. The single bat carrier comprises a bat bag made of Denier nylon with a closed bottom end, a heavy-duty plastic tube inserted into the bat bag to prevent any damage to the bat, a top end cap assembly with a hinge means that fastens to the plastic tube to cover the top opening, a zipper for connecting the end cap and the nylon bat bag, another end cap glued to the bottom side of the plastic tube to hold the bat, a plurality of nylon straps for carrying purposes and for holding a baseball or softball glove, and a snap hook for fastening the single bat carrier to a fence.

14 Claims, 3 Drawing Sheets

BAT CARRIER AND PROTECTOR

CROSS-REFERENCE TO RELATED APPPLICATION

None

FEDERALLY SPONSORED RESEARCH

Not Applicable

SEQUENCE LISTING OR PROGRAM

Not Applicable

BACKGROUND

The present invention relates generally to the field of sports bags, and more particularly to a baseball or softball bat tube and carrier that can be used to conveniently carry, transport and protect a bat.

The games of baseball and softball are well known in the United States and many other parts of the world, and enjoy continued and increasing popularity. These sports principally require the use of a bat, a ball, and a glove for each player as basic equipment. It is therefore common for players to own an assortment of bats, gloves, balls and other related accessories. Additionally, a team coach may carry a number of bats and other related baseball or softball equipment for an entire team.

Modern bats are hollow and designed to be both lightweight and resilient when striking a baseball or softball. However, they are prone to damage when struck by a hard materials such as metal or stone, or when subjected to lateral pressure, which may cause creases in, or bend the bat. Because such hazards are common around playing fields, it is important to store bats that are not in play in a secure, protective environment.

A variety of bat and other sports related bags exist in the market, and have been disclosed in the art. For example, U.S. Pat. No. 5,695,067 to Harvey discloses a storage and tote bag for baseball and softball bats and balls. It is a soft, zippered bag that stores bats by allowing them to lie flat along the bag's length and stores balls in the bottom of the bag.

U.S. Pub. No. 20040262178 to Speck discloses a baseball equipment bag having an elongated bag portion of flexible material and a substantially planar interior shelf within the elongated bag portion. The equipment bag includes a bat compartment that allows a bat to be accessed from either of two openings.

Further, in U.S. Pat. No. 6,168,016 to Lawson, a utility bag for storing equipment for a baseball/softball team is disclosed. The bag is constructed to be strapped to and transported on a golf cart. A bat bag for storing bats is attached to the outside surface of the utility bag, and contains a detachment means.

There are, however, a variety of problems associated with such equipment bags. One such problem is that they are typically meant for carrying multiple bats, making them bulky, heavy and make transporting the bats more difficult. They also typically consist merely of a nylon bag sewed together conferring little protection for the equipment contained inside.

Some new bags available in the market today are composed of metal for protection. However, these types of bags are problematic as well. They are usually expensive, too heavy and bulky to even carry a single bat, and tend to dent easily if bumped against any hard surface.

The present invention is designed to overcome the shortcomings known in the current state of the art, and provide a single baseball or softball bat carrier that can be used conveniently to carry, transport and protect a user's bat.

It is one object of the present invention to provide a single baseball or softball bat carrier that is lightweight and easy to carry.

Another object of the present invention is to provide a single baseball or softball bat carrier that is of slim and compact design.

A further object of the present invention is to provide a single baseball or softball bat carrier that is of heavy-duty construction, providing an interior tube for maximum protection of the contents, and is weather resistant.

These and other objects will become apparent from the accompanying drawings and the following description.

SUMMARY

The present invention relates to a single bat carrier that can be used to conveniently transport, store and protect a bat while traveling to or from, or participating in a baseball or softball game. The single bat carrier consists of an outer nylon bat bag with a closed bottom end and a top cap attached with a hinge mechanism. The nylon bat bag covers a heavy-duty tube made of ABS or PVC to prevent any creasing, denting or other damage to the bat.

The top cap of the heavy-duty tube is incorporated into the top cap of the bat bag and attached with a hinge mechanism. A zipper, or other means attaches the top cap to the bat bag. An adjustable shoulder strap, a snap hook, and a glove holding strap also form the parts of the single bat carrier.

In order to operate the single bat carrier, a player unzips the bat bag, opens the bat tube top end cap, inserts a bat, and closes the end cap and the zipper. The shoulder strap allows the carrier to be transported hands free. The glove strap allows a glove to be transported along with the bat. To remove the equipment, a player unsnaps the glove strap, and opens the end cap. At the playing field, the single bat carrier can be hooked onto a chain link fence with the help of the snap hook.

FIGURES—REFERENCE NUMERALS

10 . . . Single Bat Carrier
11 . . . Bat Bag
12 . . . Plastic Tube
13 . . . Foam Disk
14 . . . End Cap
15 . . . Zipper
16 . . . Shoulder Strap
17 . . . Hook Strap
18 . . . Fence Snap Hook
19 . . . Glove Strap
20 . . . Glove

DESCRIPTION

Figure 1:
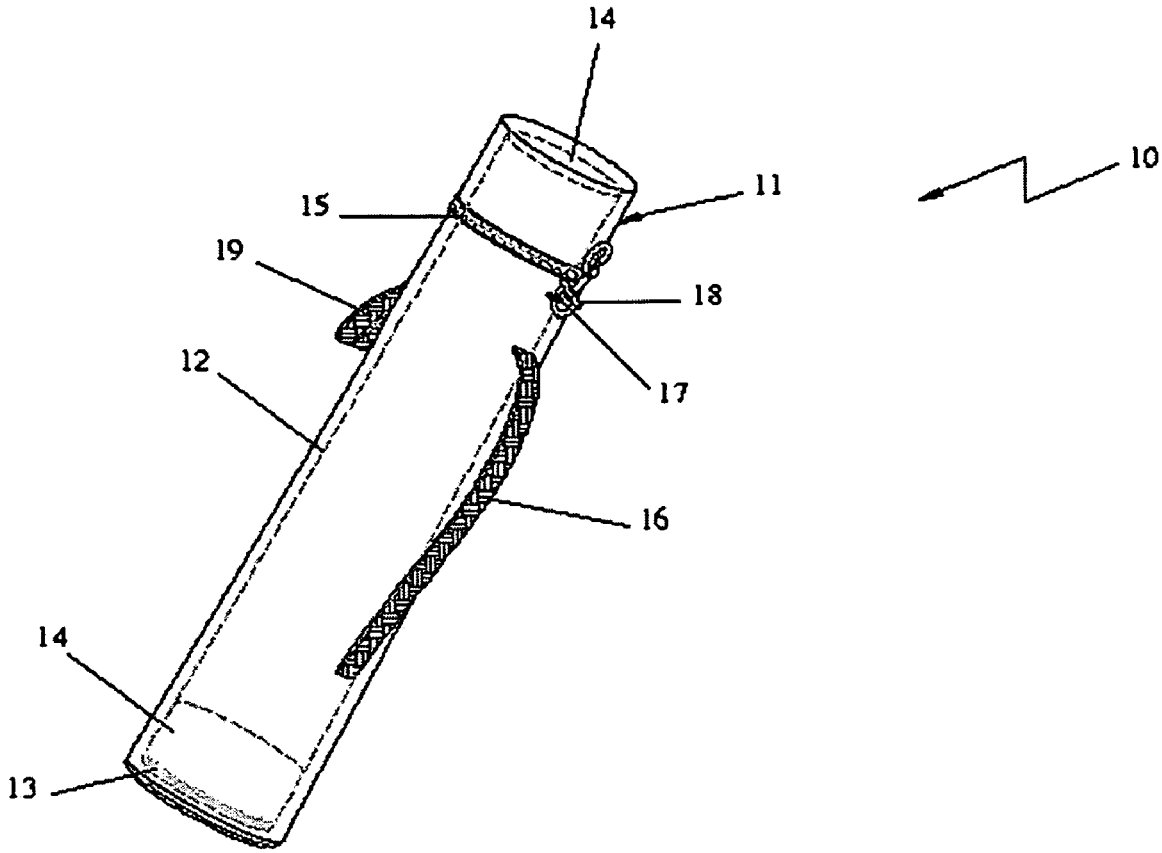
FIG. 1 is a perspective view of a single bat carrier in accordance with the present invention.

Referring to the drawings, the preferred embodiment of the single bat carrier of the present invention, which can be used for carrying baseball or softball bats, is illustrated and generally indicated as 10 in FIG. 1. The single bat carrier 10 comprises of a bat bag 11, which is made of resilient material, such as 600 Denier nylon.

The bat bag 11 is approximately 3.5 inches in diameter and thirty seven inches in length. The bag 11 is sewn closed at its bottom end. A heavy-duty tube 12 is inserted inside the bat bag 11 to provide protection and prevent any damage to the bat. The heavy-duty tube 12 is approximately three-and-half inches in outer diameter and thirty-five inches in length, and is made of Acrylonitrile Butadiene Styrene (ABS), PVC, or another similar heavy-duty crack resistant material.

Figure 2:
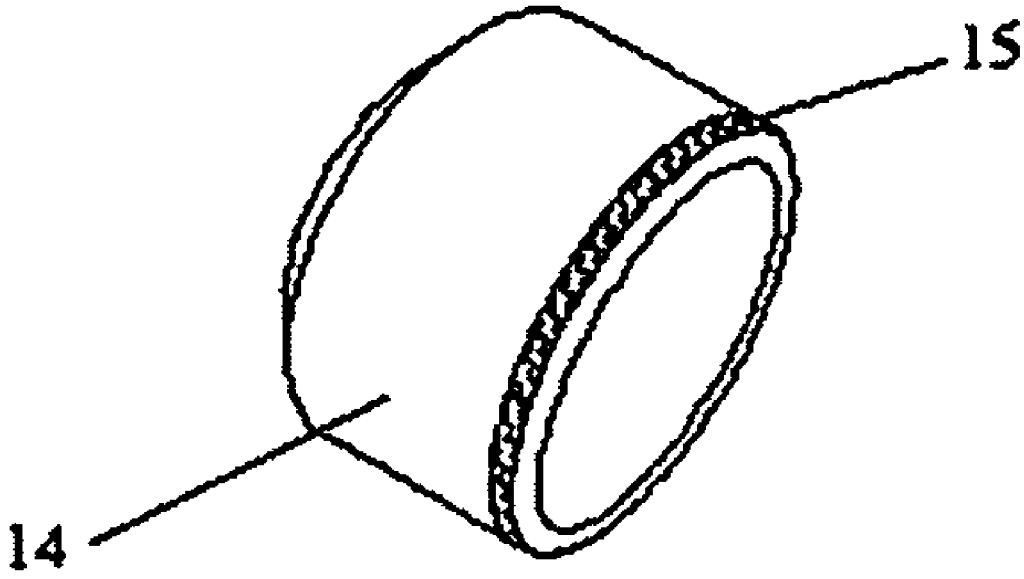
FIG. 2 is a perspective view of an end cap used to cover the plastic tube of the present invention.

A disk 13 comprised of 200 lb half inch foam is located in the plastic tube 12 at the bottom end and is used to absorb the impact of a bat being inserted into the bat bag 11. The foam disk 13 is approximately one half inch thick, and rests against the nylon cover at the bottom of the bag. Referring to FIG. 2, the foam disk 13 rests against an end cap 14 which is composed of the same material as the heavy-duty tube 12, and is affixed permanently to the bottom of the tube 12.

A top end cap 14 shown in FIG. 2 is placed at the top opening of the heavy-duty tube 12 to cover the tube opening. The top end cap 14 is approximately 3.75 inches in diameter, approximately two inches in height around the circumference of the cap, and remains attached to the carrier 10 via a nylon or other similar hinge mechanism. The top end cap is made of the same material as the heavy-duty tube. The top end cap 14 on the top end of the plastic tube 12 is also covered with the same denier nylon, or other resilient material as the bag 11.

The nylon covering the top end cap 14 and the nylon material of the bag 11 connect together with a zipper 15, or other similar means, which is located at a sufficient distance from the top end of the bat bag 11 so as to seal the bat safely within the heavy-duty tube 12 of the bat carrier 10. Also, there is a bottom end cap 14 that is glued or sealed to the bottom end of the plastic tube 12, which helps to prevent a bat from resting against the nylon bat bag 11 on the bottom of the carrier.

On the outer surface of the bat bag 11 an adjustable nylon shoulder strap 16 is disposed, which is sewn onto, or otherwise incorporated into the bat bag 11. The shoulder strap 16 is adjustable, and can be used to conveniently carry a bat to and from games, while leaving a player's hands free to carry other equipment. The shoulder strap 16 is approximately forty-two inches by one inch.

Figure 3:
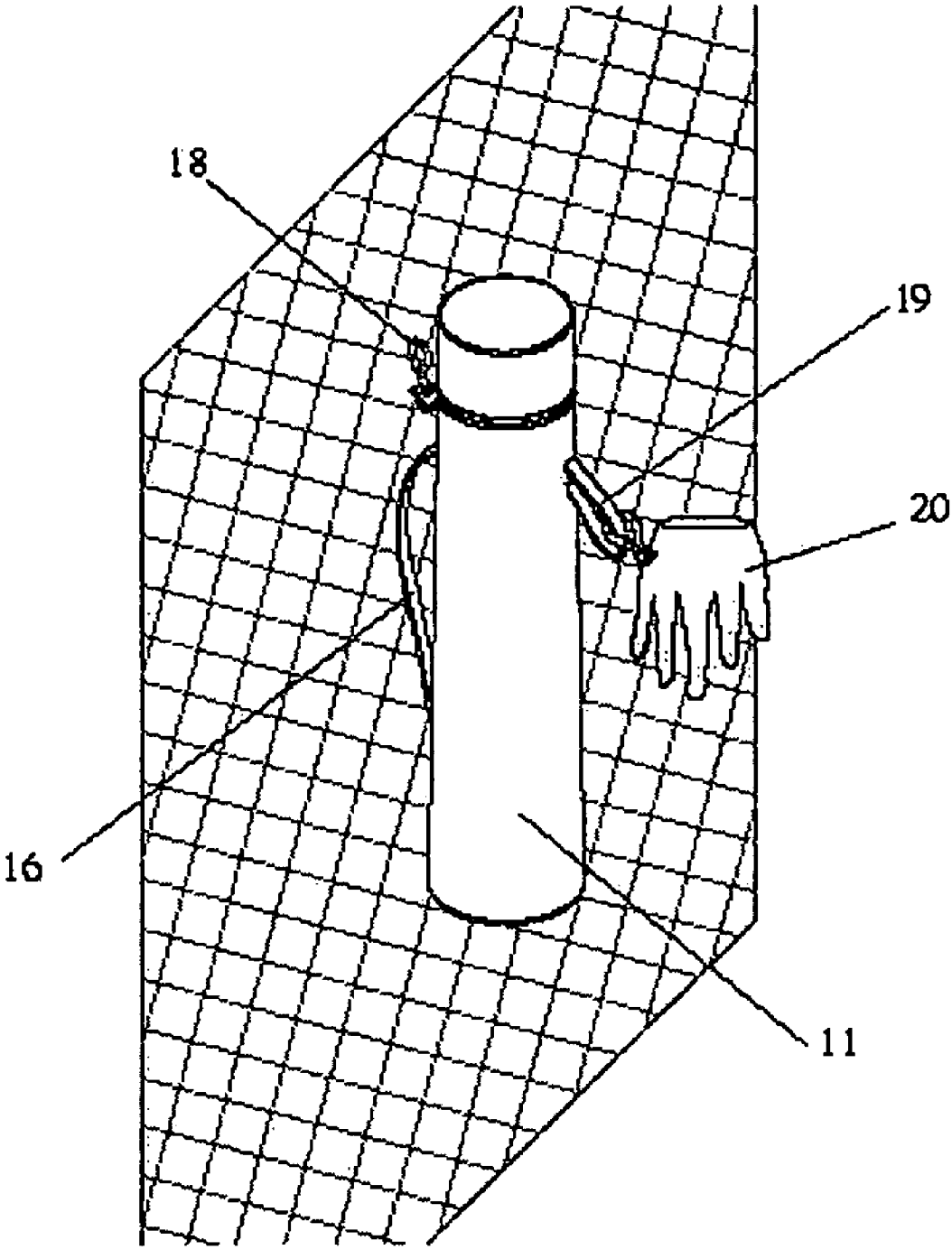
FIG. 3 is an illustration of the single bat carrier of the present invention that is attached with a user's glove and is hung on a fence.

A second strap 17 is attached to the same side of the bat bag 11 as the shoulder strap 16. The second strap 17 is approximately one by 1.5 inches, and can be used for looping a key ring through, or to hold a snap hook 18 or carabiner-style clip to attach the carrier 10 to a chain link fence. The bat bag 11 has a nylon glove strap 19 on the opposite side of the tube 12 with a snap button (not shown) incorporated onto the bat bag 11 and used for holding a player's baseball or softball glove, as seen in FIG. 3. The glove strap 19 has dimensions of approximately ten inches by one inch.

In order to use the single bat carrier 10 of the present invention, a user simply unzips the bat bag 11, removes the end cap 14 at the top, inserts a bat into the heavy-duty tube 12, closes the end cap 14 at the top, and zips the bat bag 11 closed. The glove holding strap 19 can be unsnapped, looped through a glove 20, and refastened. A player can then transport the carrier 10 on their shoulder using the shoulder strap 16. At the playing field, the single bat carrier can be hooked on to a chain link fence with the help of the snap hook 18. The glove can then be detached, the bat bag 11 unzipped, the bat removed and ready for play.

All features disclosed in this specification, including any accompanying claims, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

While specific apparatus has been disclosed in the preceding description, it should be understood that these specifics have been given for the purpose of disclosing the principles of the present invention and that many variations thereof will become apparent to those who are versed in the art. Therefore, the scope of the present invention is to be determined by the appended claims.

Any element in a claim that does not explicitly state "means for" performing a specified function, or "step for" performing a specific function, is not to be interpreted as a "means" or "step" clause as specified in 35 U.S.C. § 112, paragraph 6. In particular, the use of "step of" in the claims herein is not intended to invoke the provisions of 35 U.S.C. § 112, paragraph 6.

What is claimed is:

1. A single bat carrier for storing and transporting a baseball or softball bat, comprising;

an oblong, tubular bat bag having a tubular main portion, a circular closed bottom portion, and a top end portion forming a cap that can be opened and closed with a sealing means and a hinge mechanism to maintain contact between the top cap end and rest of the bag;

a heavy-duty cylindrical tube having approximately the same dimensions as the tubular bat bag, inserted inside the bat bag, with a bottom end cap permanently attached to the tube, and a removable top end cap disposed inside the top cap of the bat bag forming a top end cap assembly;

a disk of impact reducing material, equal in diameter to the heavy-duty cylindrical tube disposed inside the heavy-duty tube at the junction of the bottom end of the tube and the bottom end cap;

a means for securing the top end cap assembly to the top end of the tube, and a hinge mechanism to maintain contact between the top end cap assembly and the tube when the top end cap assembly is open;

an adjustable shoulder strap attached to the side of the outer surface of the bat bag;

a smaller strap disposed adjacent to the shoulder strap to accommodate a key ring, and an attachment means for hanging the bat carrier from a support such as a chain link fence;

a third strap attached to the opposite side of the bat bag with a snap closure used for holding a baseball or softball glove.

2. The single bat carrier of claim 1, wherein said bat bag is made of 600 Denier nylon material.

3. The single bat carrier of claim 2, whereby the bat bag is approximately 3.5 inches in diameter and 37 inches in length.

4. The single bat carrier of claim 1, wherein said heavy-duty cylindrical tube is made of Acrylonitrile Butadiene Styrene (ABS) material, or another similar heavy duty, crack resistant polymer or plastic.

5. The single bat carrier of claim 4, whereby the heavy-duty tube is approximately 3.5 inches in outer diameter and 35 inches in length.

6. The single bat carrier of claim 1, wherein said foam disk is approximately 0.5 inch thick and comprises 200 lb foam.

7. The single bat carrier of claim 1, wherein said end caps are made of heavy-duty Acrylonitrile Butadiene Styrene (ABS) material.

8. The single bat carrier of claim 7, whereby the end caps are approximately 2 inches in height, and 3 inches inner diameter.

9. The single bat carrier of claim 1, wherein the end cap placed on the top end of the tube is incorporated into the Denier nylon material, forming a cap assembly, while the end cap on the bottom end of the tube is permanently attached.

10. The single bat carrier of claim 1, wherein said means for securing the end cap to the top end of the tube includes a zipper.

11. The single bat carrier of claim 1, wherein all the straps are made of nylon and are sewed to the outer surface of the bat bag.

12. The single bat carrier of claim 1, wherein said adjustable shoulder strap has dimensions of 42 inches by 1 inch approximately.

13. The single bat carrier of claim 1, wherein the strap used for holding the snap hook has dimensions of 1.5 inches by 1 inch approximately.

14. The single bat carrier of claim 1, wherein the strap used for holding the baseball/softball glove of a user has dimensions of 10 inches by 1 inch approximately.

* * * * *